US009336699B2

(12) United States Patent
Haddad

(10) Patent No.: US 9,336,699 B2
(45) Date of Patent: May 10, 2016

(54) ILLUMINATED SIGN APPARATUS

(71) Applicant: Salim D. Haddad, Troy, MI (US)

(72) Inventor: Salim D. Haddad, Troy, MI (US)

( * ) Notice: Subject to any disclaimer, the term of this patent is extended or adjusted under 35 U.S.C. 154(b) by 0 days.

(21) Appl. No.: 14/800,001

(22) Filed: Jul. 15, 2015

(65) Prior Publication Data

US 2016/0019821 A1 Jan. 21, 2016

Related U.S. Application Data

(60) Provisional application No. 62/024,701, filed on Jul. 15, 2014.

(51) Int. Cl.

| | |
|---|---|
| ***G09F 13/04*** | (2006.01) |
| ***G09F 13/18*** | (2006.01) |
| ***G09F 13/22*** | (2006.01) |

(52) U.S. Cl.

CPC ..... *G09F 13/18* (2013.01); *G09F 13/22* (2013.01); *G09F 2013/222* (2013.01)

(58) Field of Classification Search

CPC ..... G09F 13/0404; G09F 13/0413; G09F 2003/0445; G09F 2013/222

See application file for complete search history.

(56) References Cited

U.S. PATENT DOCUMENTS

| | | | | |
|---|---|---|---|---|
| 1,820,913 | A * | 9/1931 | Kelly | G09F 13/26 40/552 |
| 2,584,253 | A * | 2/1952 | Braun, Sr. | G09F 13/06 40/552 |
| 2,651,864 | A | 9/1953 | Howenstine | |
| 2,651,865 | A | 9/1953 | Howenstine | |
| 3,372,504 | A | 3/1968 | Hardesty | |
| 3,396,483 | A * | 8/1968 | Stein | G09F 13/0413 40/549 |
| 5,440,464 | A | 8/1995 | Nowlin et al. | |
| 5,829,177 | A | 11/1998 | Hjaltason | |
| 5,918,396 | A | 7/1999 | Jung | |
| 6,042,243 | A * | 3/2000 | Grill | G09F 13/0413 362/125 |
| 6,240,664 | B1 | 6/2001 | Hjaltason | |
| 7,162,821 | B2 | 1/2007 | Venkataraman et al. | |
| 7,412,790 | B2 | 8/2008 | Riopel et al. | |
| 7,467,486 | B2 | 12/2008 | Kaoh | |
| 8,375,613 | B2 * | 2/2013 | Spiro | G02B 6/0086 362/606 |
| 8,496,371 | B2 | 7/2013 | Chang et al. | |
| 2007/0283604 | A1 * | 12/2007 | Kaoh | G09F 13/22 40/552 |
| 2013/0255118 | A1 * | 10/2013 | Warren | G09F 13/0404 40/572 |
| 2014/0173953 | A1 | 6/2014 | Bloom et al. | |

* cited by examiner

*Primary Examiner* — Gary Hoge

(74) *Attorney, Agent, or Firm* — Harness, Dickey & Pierce, P.L.C.

(57) ABSTRACT

A sign apparatus includes a front display panel and a solid halo panel that are illuminated by a light module. The front display panel is arranged along one side of a frame and the solid halo panel is arranged on the other side of the frame. The light module is disposed within the frame between the front display panel and the solid halo panel. The solid halo panel follows a contour of the front display panel and extends beyond a periphery of the front display panel such that the solid halo panel forms a halo border along the periphery of the front display panel when viewed from a direction toward the front display panel.

16 Claims, 3 Drawing Sheets

ILLUMINATED SIGN APPARATUS

CROSS-REFERENCE TO RELATED APPLICATIONS

This application claims the benefit of U.S. Provisional Application No. 62/024,701, filed on Jul. 15, 2014. The entire disclosure of the above application is incorporated herein by reference.

FIELD

The present disclosure relates to illuminated signs. More particularly, to signage having multi-layer illuminated panels.

BACKGROUND

It is common practice for organizations, such as companies and/or businesses, to have a sign mounted outside or inside of their facility. Such signs are typically designed to identify and attract consumers and/or clients to the organization.

SUMMARY

This section provides a general summary of the disclosure, and is not a comprehensive disclosure of its full scope or all of its features.

The present disclosure provides for a sign apparatus that includes a front display panel and a solid halo panel disposed in parallel with the front display panel. The front display panel and the solid halo panel are attached to a frame, such that one side of the frame is coupled to the front display panel and the other side of the frame is coupled to the solid halo panel. A light module is disposed within the frame to illuminate the front display panel and the solid halo panel.

The solid halo panel follows a contour of the front display panel and extends beyond a perimeter of the front display panel, such that the solid halo panel forms a border along the perimeter of the front display panel. The solid halo panel creates a halo effect (i.e., illuminated ring) about the front panel display. Accordingly, when viewed in a direction facing the front display panel, the sign apparatus has a solid halo that highlights the contour of the front display panel.

In an aspect of the present disclosure, the frame has an opaque surface to prevent light emitted from the light module to transmit through the frame.

In another aspect of the present disclosure, the light module may include a first light module for illuminating the front display panel and a second light module separate from the first light module for illuminating the solid halo panel.

Further areas of applicability will become apparent from the description provided herein. The description and specific examples in this summary are intended for purposes of illustration only, and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Organizations, such as restaurants and retail establishments, typically have an illuminated sign for informing consumers of the location of their establishment. A sign apparatus of the present disclosure includes a solid halo panel that extends past a perimeter of a front display panel to highlight the character and/or shape formed by the front display panel. Thus, the sign apparatus provides a halo effect for highlighting the logo represented by the sign apparatus.

Figure 1:
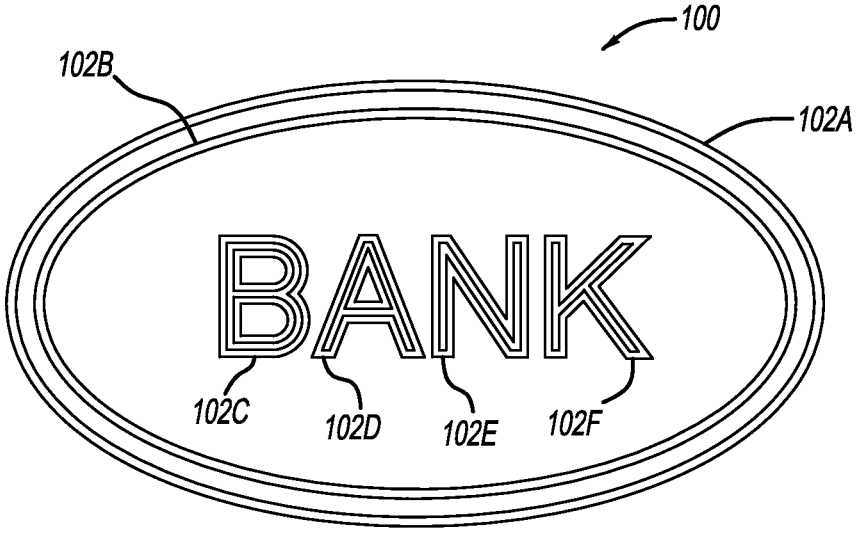
FIG. 1 is a perspective view of a sign apparatus of the present disclosure.

The present disclosure will now be described with reference to the accompanying drawings. FIG. 1 illustrates a sign apparatus 100 made of characters and/or shapes for conveying information of an organization. The characters and/or shapes of the sign apparatus 100 may be provided as a member 102. As an example, the sign apparatus 100 conveys a logo of a business and includes members 102A to 102F, which are collectively referred to as members 102. The sign apparatus 100 of the present disclosure may be designed to convey various information, and is not limited to the logo depicted in the figures.

Figure 2:
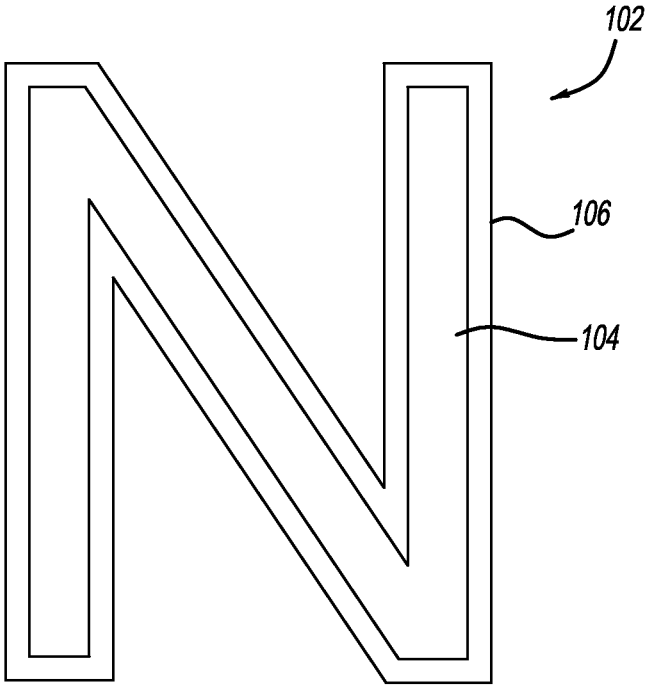
FIG. 2 is an enlarged view of a member of the sign apparatus of FIG. 1.

With reference to FIG. 2, the member 102 includes a front display panel 104 and a solid halo panel 106, which are collectively referred to as panels 104 and 106. The front display panel 104 of the member 102 is a front face of the sign apparatus 100, and the solid halo panel 106 is behind the front display panel 104. The panels 104 and 106 may be made of acrylic, vinyl, and/or another plastic-like substrate. In particular, the panels 104 and 106 are configured to allow light that is being emitted within the apparatus 100 to transmit through the panels 104 and 106. For example, the front display panel 104 and the solid halo panel 106 may be a clear plastic substrate that has a colored film, such as colored vinyl, disposed on the surfaces of the substrate. The colored film may be disposed on an outer surface of the panels 104 and 106.

Figure 3:
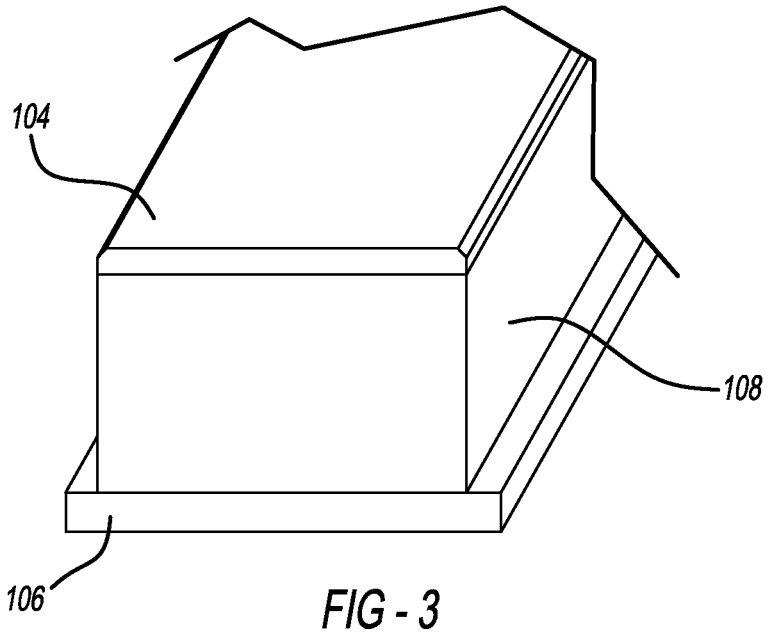
FIG. 3 is a perspective view of the sign apparatus having a front display panel and a solid halo panel.
Figure 4:
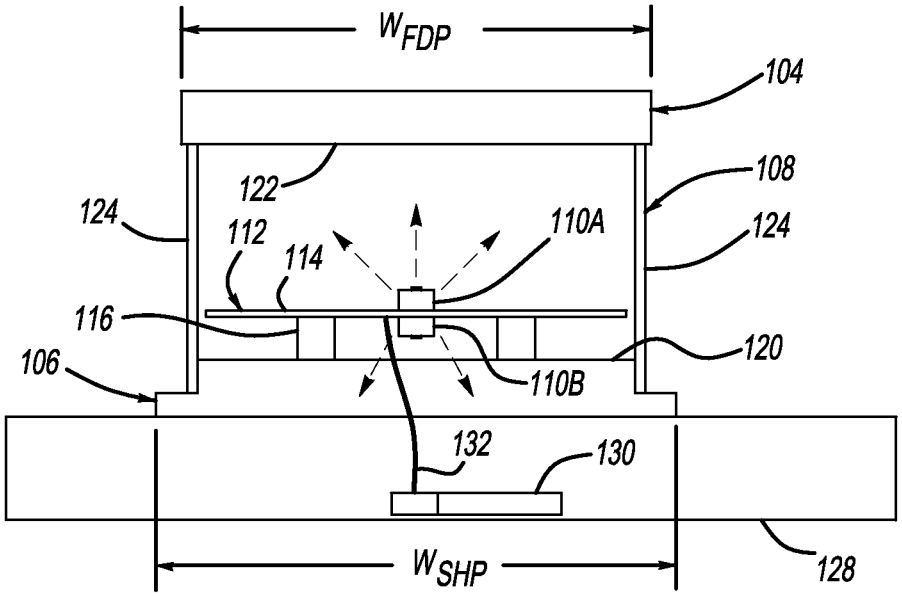
FIG. 4 is a cross-sectional view of the sign apparatus having the front display panel and the solid halo panel.

With reference to FIGS. 3 and 4, the member 102 includes a frame 108 that supports the front display panel 104 and the solid halo panel 106. The front display panel 104 is disposed on one side of the frame 108 (i.e., a first side), and the solid halo panel 106 is disposed on the other side of the frame 108 opposite the front display panel 104 (i.e., a second side). The front display panel 104 and the solid halo panel 106 may be attached to the frame 108 by way of mechanical fasteners and/or adhesives.

The solid halo panel 106 is configured to follow the contour of the front display panel 104 and extend beyond a perimeter of the front display panel 104. For example, as illustrated in FIG. 4, a width $W_{SHP}$ of the solid halo panel 106 is longer than a width $W_{FDP}$ of the front display panel 104. Accordingly, when the sign apparatus 100 is viewed in a direction toward the front display panel 104, the solid halo panel 106 is visible and forms a border or halo around the contour of the front display panel 104.

Figure 5:
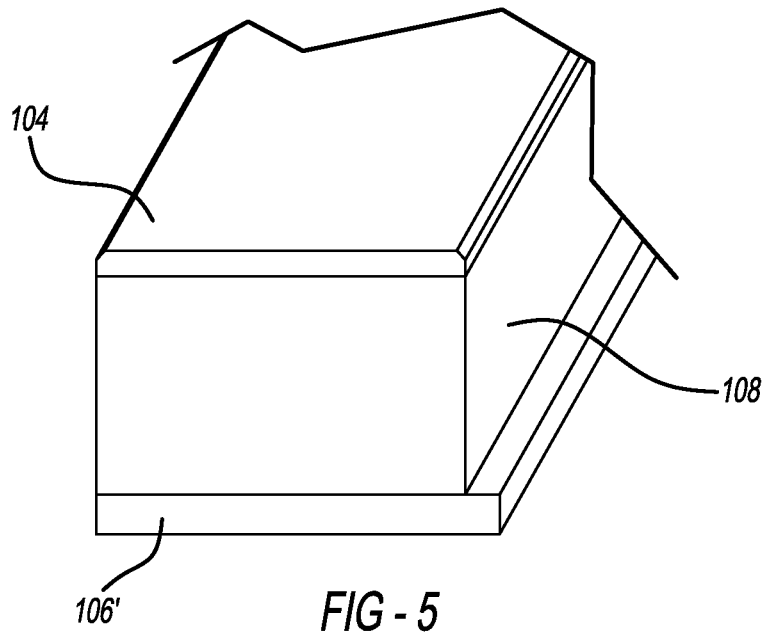
FIG. 5 is a perspective view of a front display panel and a solid halo panel in an alternative embodiment.

In the example embodiment, the solid halo panel 106 extends beyond the perimeter of the front display panel 104 on either side of the front display panel 104. Alternatively, the solid halo panel 106 may extend beyond one side of the front display panel 104. Specifically, FIG. 5 illustrates a solid halo panel 106' that extends beyond the perimeter of the front display panel 104 along one side of the front display panel 104. Thus, the solid halo panel 106' is visible along the one side of the front display panel 104.

The sign apparatus 100 further includes one or more light modules. More particularly, the sign apparatus 100 includes a first light module 110A and a second light module 110B for illuminating the front display panel 104 and the solid halo panel 106, respectively. The first light module 110A and the second light module 110B may collectively be referred to as light modules 110. Each of the light modules 110 includes multiple light sources, such as light emitting diodes (LEDS), to illuminate the member 102. The light modules 110 are disposed within the frame 108. Specifically, the front display panel 104, the frame 108, and the solid halo panel 106 define a cavity that houses the light modules 110 between the front display panel 104 and the solid halo panel 106.

The light modules 110 are supported on a support member 112 that includes a divider 114 and an attachment member 116. The divider 114 may extend along a width of the frame 108 and follow the contour of the frame 108 and the panels 104 and 106. The light modules 110 are disposed along a surface of the divider 114 and may be coupled to the divider 114 by way of, for example, an adhesive and/or mechanical fastener. As an example, the first light module 110A is positioned along a first surface of the divider 114 to direct light toward the front display panel 104, and the second light module 110B is positioned along a second surface of the divider 114 opposite to the first surface to direct light toward the solid halo panel 106.

The attachment member 116 secures the position of the divider 114 within the frame 108. For example, in the example embodiment, the attachment member 116 is coupled to the divider 114 and an inner surface 120 of the solid halo panel 106. In lieu of or in addition to the solid halo panel 108, the attachment member 116 may secure the position of the divider by coupling to the frame 108 and/or an inner surface 122 of the front display panel 104.

In addition to supporting the light modules 110, the divider 114 also masks the light emitted by one of the light modules 110 from the light emitted from the other light module 110. Accordingly, the light emitted from the first light module 110A, which illuminates the front display panel 104, does not interfere with the light emitted from the second light module 110B, which illuminates the solid halo panel 106. By having the divider 114, the sign apparatus 100 separates the illumination of the front display panel 104 and the solid halo panel 106, such that each panel has a designated light module 110 for providing sufficient light to illuminate the respective panel. In addition, the divider 114 may also allow the sign apparatus 100 to use different color light sources for the first light module 110A and the second light module 110B.

In the example embodiment, two light modules 110 are used to illuminate the front display panel 104 and the solid halo panel 106. Alternatively, the member 102 may include one light module 110 that emits light to illuminate both the front display panel 104 and the solid halo panel 106. In such a configuration, the divider 114 should be configured to permit the light from the light module to pass through the divider to illuminate the panels 104 and 106.

The front display panel 104 and the solid halo panel 106 emit the light emitted from the first light module 110A and the second light module 110B, respectively, to illuminate the member 102. The frame 108 has an opaque surface, such that light from the light modules 110 disposed in the frame 108 is not emitted from side walls 124 of the frame 108. That is, the frame 108 is not illuminated.

The sign apparatus 100 may be mounted to a background panel 128, such as a wall, for support. The sign apparatus 100 is electrically coupled to a power supply 130, such as an electrical outlet, via a power cord 132. The power supply 130 supplies electrical power for the light modules 110 of the sign apparatus 100.

The light source of the light modules 110 is strategically placed, such that the light emitted from the light modules 110 transmits through the front display panel 104 and the solid halo panel 106 to illuminate the member 102. Specifically, the light from the light modules 110 is projected toward the panels 104 and 106, such that the light is incident on and emitted from the panels 104 and 106. Since the solid halo panel 106 is positioned beneath/under the front display panel 104, only the edges of the solid halo panel 106 that extend beyond the periphery of the front display panel 104 are visible when the sign apparatus 100 is viewed in a direction toward the front display panel 104. Accordingly, the solid halo panel 106 forms a defined outline around the contour of the front display panel 104, thereby highlighting the characters and/or shapes formed by the sign apparatus 100. The sign apparatus 100 of the present disclosure can be used for both indoor and outdoor signage.

Figure 6:
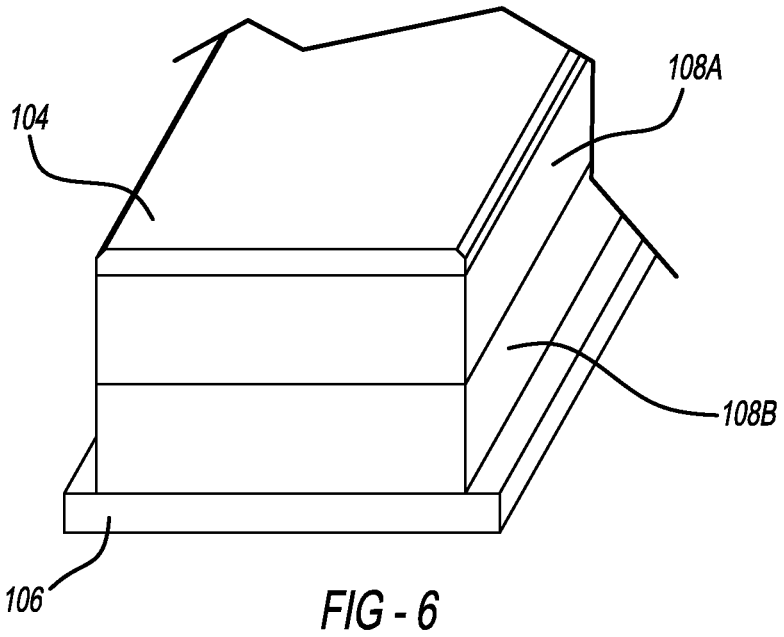
FIG. 6 is a perspective view of a frame having a first sub-frame and a second sub-frame.

In the example embodiment, the front display panel 104 and the solid halo panel 106 are supported by a single-piece frame 108. Alternatively, the frame may be made of multiple pieces, such that the front display panel 104 and the solid halo panel 106 are supported by separate frames that are coupled together. For example, FIG. 6 illustrates a sub-frame 108A and a sub-frame 108B that form the frame. The sub-frame 108A is coupled to the front display panel 104, and the sub-frame 108B is coupled to the solid halo panel 106. The sub-frames 108A and 108B are fixedly attached to each other by way of, for example, mechanical fasteners and/or adhesives. In such a configuration, each sub-frame would house a light module for lighting the respective panel.

In the example embodiment, the sign apparatus 100 is mounted to a background panel, such as a wall or a board. Alternatively, the sign apparatus may be fixed to a freestanding mount/stand with no background via, for example, the solid halo panel 106.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth, such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail.

What is claimed is:

1. A sign apparatus comprising:

a frame;

a front display panel arranged along a first side of the frame;

a solid halo panel arranged along a second side of the frame opposite to the first side of the frame, wherein the solid halo panel follows a contour of the front display panel and extends beyond a periphery of the front display panel such that the solid halo panel forms a halo border along the periphery of the front display panel when viewed from a direction toward the front display panel; and a light module having at least one light source for emitting light, wherein the light module is disposed within the frame between the front display panel and the solid halo panel, and the light module is configured to illuminate the front display panel and the solid halo panel by way of the light source.

2. The sign apparatus of claim 1 further comprising:

a support member disposed and extending within the frame to follow a contour of the front display panel and the solid halo panel, wherein:

the light module includes a first light module and a second light module separate from the first light module, the first light module is arranged along a first surface of the support member to emit light toward the front display panel, and the second light module is arranged along a second surface of the support member opposite to the first surface to emit light toward the solid halo panel.

3. The sign apparatus of claim 2 wherein the first surface and the second surface of the support member are opaque.

4. The sign apparatus of claim 1 wherein the frame has an opaque surface.

5. The sign apparatus of claim 1 wherein both the front display panel and the solid halo panel include a plastic substrate and a colored film disposed along an exterior surface of the substrate.

6. The sign apparatus of claim 1 further comprising:

a support member disposed and extending within the frame to follow a contour of the front display panel and the solid halo panel, wherein the light module is disposed along a surface of the support member to emit light towards both the front display panel and the solid halo panel.

7. The sign apparatus of claim 1 wherein:

the frame is a multi-piece frame that includes a first sub-frame and a second sub-frame that are attached to each other, and the front display panel is attached to the first sub-frame and the solid halo panel is attached to the second sub-frame, and the light module includes a first light module and a second light module separate from the first light module, the first light module is disposed in the first sub-frame to illuminate the front display panel and the second light module is disposed in the second sub-frame to illuminate the solid halo panel.

8. A sign apparatus comprising:

a frame having an opaque surface;

a front display panel arranged along a first side of the frame;

a solid halo panel arranged along a second side of the frame opposite to the first side of the frame, wherein the solid halo panel follows a contour of the front display panel and extends beyond a periphery of the front display panel such that the solid halo panel forms a halo border along the periphery of the front display panel when viewed from a direction toward the front display panel; and a first light module and a second light module separate from the first light module, wherein:

the frame, the front display panel, and a solid halo panel define a cavity that houses the first light module and the second light module, and the first light module is arranged to emit light toward the front display panel and the second light module is arranged to emit light toward the solid halo panel such that the first light module and the second light module illuminate the front display panel and the solid halo panel, respectively.

9. The sign apparatus of claim 8 wherein both the front display panel and the solid halo panel include a clear plastic substrate and a colored film disposed along an exterior surface of the substrate.

10. The sign apparatus of claim 9 wherein the colored film is colored vinyl.

11. The sign apparatus of claim 8 wherein the solid halo panel extends beyond either side of the front display panel such that the solid halo panel forms a border around the front display panel when viewed from the direction toward the front display panel.

12. The sign apparatus of claim 8 wherein the solid halo panel extends beyond one side of the front display panel such that the solid halo panel forms a border along the one side of the front display panel when viewed from the direction toward the front display panel.

13. The sign apparatus of claim 8 further comprising:

a divider disposed within the cavity, wherein:

the first light module is arranged along a first surface of the divider to emit light toward the front display panel, and the second light module is arranged along a second surface of the divider opposite to the first surface to emit light toward the solid halo panel.

14. The sign apparatus of claim 8 wherein the first light module and the second light module both include a plurality of light sources that emit light.

15. The sign apparatus of claim 8 wherein the frame is a multi-piece frame that includes a first sub-frame and a second sub-frame that are attached to each other, and the front display panel is attached to the first sub-frame and the solid halo panel is attached to the second sub-frame.

16. The sign apparatus of claim 15 wherein the first light module is disposed in the first sub-frame to illuminate the front display panel and the second light module is disposed in the second sub-frame to illuminate the solid halo panel.

* * * * *